US010308458B2

(12) United States Patent
Takahashi et al.

(10) Patent No.: US 10,308,458 B2
(45) Date of Patent: Jun. 4, 2019

(54) IMAGE FORMING APPARATUS

(71) Applicant: CANON KABUSHIKI KAISHA, Tokyo (JP)

(72) Inventors: Keita Takahashi, Abiko (JP); Shinnosuke Iwadate, Toride (JP); Teruhito Kai, Kashiwa (JP); Hiroto Nishihara, Tsukuba (JP); Hiromi Shimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/613,544

(22) Filed: Jun. 5, 2017

(65) Prior Publication Data

US 2017/0355186 A1 Dec. 14, 2017

(30) Foreign Application Priority Data

Jun. 10, 2016 (JP) ..... 2016-116132

(51) Int. Cl.

| | |
|---|---|
| ***B65H 7/18*** | (2006.01) |
| ***B65H 7/02*** | (2006.01) |
| ***B65H 7/20*** | (2006.01) |
| ***G03G 15/00*** | (2006.01) |

(Continued)

(52) U.S. Cl.

CPC ..... *B65H 7/18* (2013.01); *B41J 2/04501* (2013.01); *B41J 2/04573* (2013.01); *B65H 7/02* (2013.01); *B65H 7/20* (2013.01); *G03G 15/50* (2013.01); *G03G 15/5008* (2013.01); *G03G 15/5029* (2013.01); *G03G 15/6508* (2013.01); *G03G 15/6511* (2013.01); *G03G 15/6558* (2013.01); *G03G 15/6564* (2013.01); *G03G 15/6591* (2013.01); *B65H 2511/10* (2013.01);

(Continued)

(58) Field of Classification Search

CPC ..... B65H 7/18; B65H 2511/416; B65H 2513/514; G03G 15/6564; G03G 15/6558; G03G 15/5008

See application file for complete search history.

(56) References Cited

U.S. PATENT DOCUMENTS

| | | | |
|---|---|---|---|
| 5,290,024 | A | 3/1994 | Takahashi |
| 6,311,039 | B1 | 10/2001 | Funamizu et al. |
| 6,397,035 | B2 | 5/2002 | Kataoka et al. |

(Continued)

FOREIGN PATENT DOCUMENTS

| | | | |
|---|---|---|---|
| JP | 60-120369 | A | 6/1985 |
| JP | 03-36559 | A | 2/1991 |

*Primary Examiner* — Patrick Cicchino

(74) *Attorney, Agent, or Firm* — Venable LLP

(57) ABSTRACT

Disclosed is an image forming apparatus which includes: a feeding portion configured to feed a sheet; an image forming portion configured to form an image on the sheet; a conveying portion configured to stop the sheet fed by the feeding portion at a predetermined position and to convey the sheet to the image forming portion in accordance with a timing of forming the image by the image forming portion; a type discriminating portion configured to discriminate whether a type of the sheet to be fed belongs to a first sheet type group including plain paper or to a second sheet type group including coated paper; and a controlling portion configured to control feeding of the sheet, wherein the controlling portion is configured to change a sheet feeding start timing of the feeding portion in accordance with the type discriminated by the type discriminating portion.

20 Claims, 14 Drawing Sheets

(51) Int. Cl.
*B41J 2/04* (2006.01)
*B41J 2/045* (2006.01)

(52) U.S. Cl.
CPC .... *B65H 2511/20* (2013.01); *B65H 2511/416* (2013.01); *B65H 2513/514* (2013.01)

(56) References Cited

U.S. PATENT DOCUMENTS

| | | | | |
|---|---|---|---|---|
| 6,651,980 | B2 | 11/2003 | Isemura et al. | |
| 7,391,980 | B2 * | 6/2008 | Sekiguchi | G03G 15/70 399/122 |
| 8,180,234 | B2 | 5/2012 | Takahashi et al. | |
| 8,561,978 | B2 | 10/2013 | Takahashi et al. | |
| 2006/0020365 | A1 * | 1/2006 | Takeda | G03G 15/6591 700/226 |
| 2009/0268220 | A1 * | 10/2009 | Obata | H04N 1/00867 358/1.9 |
| 2012/0002227 | A1 * | 1/2012 | Ogino | B41J 11/009 358/1.12 |
| 2012/0305621 | A1 * | 12/2012 | Horaguchi | B41J 11/42 226/4 |
| 2013/0026699 | A1 * | 1/2013 | Maruta | G03G 15/6564 271/110 |
| 2015/0220044 | A1 * | 8/2015 | Tatsumoto | H02J 3/38 307/43 |
| 2017/0066610 | A1 | 3/2017 | Kai et al. | |
| 2017/0068197 | A1 | 3/2017 | Kai et al. | |
| 2017/0315480 | A1 * | 11/2017 | Momiyama | G03G 15/6529 |

* cited by examiner

*FIG. 5*

| | FEEDING TYPE |
|---|---|
| THIN PAPER | A |
| PLAIN PAPER | A |
| THICK PAPER | A |
| COATED PAPER | B |
| RECYCLED PAPER | A |
| CARBON PAPER | B |
| CARBONLESS PAPER | B |
| OHP | B |

IMAGE FORMING APPARATUS

BACKGROUND OF THE INVENTION

Field of the Invention

The present invention relates to an image forming apparatus which performs image formation while continuously conveying sheets, such as a copying machine and a printer.

Description of the Related Art

Conventionally, in an image forming apparatus such as a copying machine and a laser beam printer, the recording position of an image with respect to a recording sheet sometimes deviates due to variations in sheet conveying accuracy, positional accuracy of a toner image to be recorded and so on. Therefore, various techniques have been proposed regarding the registration of the toner image with respect to the sheet.

For example, the technique is proposed by Japanese Patent Laid-Open No. S60-120369 in which the registration is carried out in the configuration in which a sheet detection sensor is disposed in the sheet conveying path, and once a sheet reaches the detection sensor, the pair of registration rollers is temporarily stopped, and the pair of registration rollers is driven for conveying again taking into consideration the arrival timing of the formed toner image.

In addition, the technique has been proposed by Japanese Patent Application Laid-open No. H03-36559 in which an image is formed with the timing based on a detection signal from a sheet detection sensor, and the formed toner image is transferred to a sheet.

In these techniques, it is common to design the apparatus such that the feeding control of sheets from a sheet stacking portion at the timing as early as possible and a large margin of delay for sheet conveying from the sheet stacking section to the pair of registration rollers is allowed. This is because the sheet jam is suppressed by presuming a reduction in conveying efficiency caused by roller slip due to abrasion or paper dust adhesion of rollers up to the registration roller pair and separation failure due to the sheets on the sheet stacking portion sticking to each other.

However, when the control for starting the sheet feeding at the timing as early as possible is performed, if the image formation interval becomes large by for example adjustment control for stabilizing the color tone, the sheet conveyed to the pair of registration roller has to wait there for a time longer than usual. In such a case, special paper such as coated paper has a possibility that the surface of the sheet is deformed due to long-time roller gripping and image defects occurs due to transfer failure of the deformed portion. Similarly, when a standby state continues for a long time with a sheet being in contact with the registration roller, there is a possibility that a loop shape is made and remains at a tip portion of the sheet thereby causing a transfer failure.

SUMMARY OF THE INVENTION

An object of the present invention is to provide an image forming apparatus capable of suppressing image defects even when an image formation interval becomes large in a case where special paper such as coated paper is used.

An image forming apparatus according to the present invention, comprising:

a feeding portion configured to feed a sheet;

an image forming portion configured to form an image on the sheet fed by the feeding portion;

a conveying portion configured to stop the sheet fed by the feeding portion at a predetermined position and to convey the sheet to the image forming portion in accordance with timing of an image formation by the image forming portion;

a type discriminating portion configured to discriminate a type of the sheet to be fed; and a controlling portion configured to change a sheet feeding start timing of the feeding portion in accordance with the type of the sheet discriminated by the type discriminating portion such that a time period in which the sheet is being stopped by the conveying portion is changed.

Further features of the present invention will become apparent from the following description of exemplary embodiments with reference to the attached drawings.

BRIEF DESCRIPTION OF THE DRAWINGS

FIG. 5 is a table showing the relationship between sheet types and feeding types.

DESCRIPTION OF THE EMBODIMENTS

Next, embodiments of an image forming apparatus according to the present invention will be explained with reference to the drawings.

Figure 1:
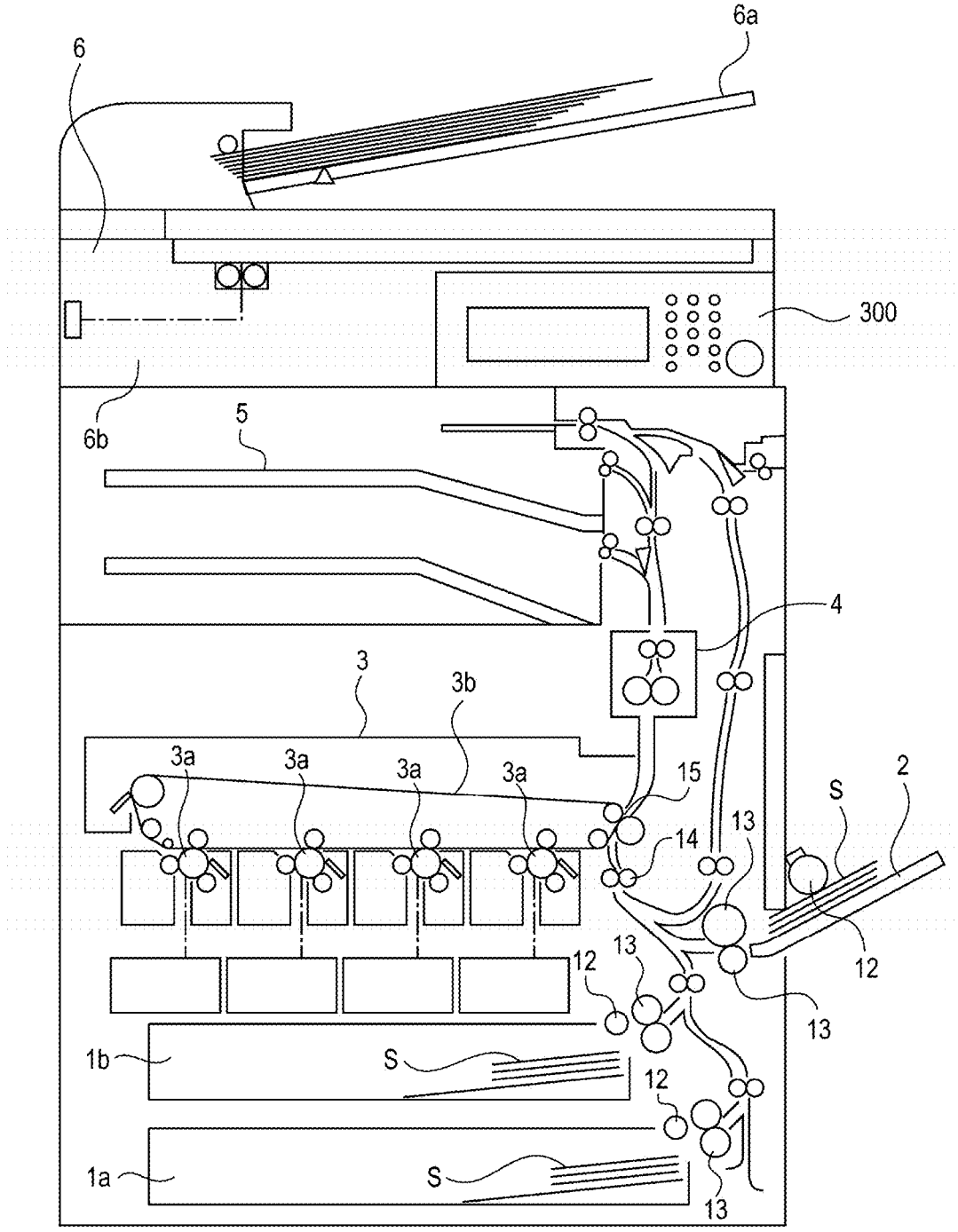
FIG. 1 is a diagram showing a cross-sectional view of an image forming apparatus body according to an embodiment of the present invention.

{First Embodiment} <Overall configuration of the image forming apparatus> First of all, an overall configuration of an image forming apparatus as well as the operation thereof will be briefly explained. FIG. 1 is a cross-sectional view of an image forming apparatus according to the present embodiment. The sheets S set in the sheet cassettes 1*a* and 1*b* mounted on the lower portion of the main body of the image forming apparatus shown in FIG. 1 or on the feeding tray 2 are fed to the image forming portion 3 in synchronization with the image forming operation where the formed image is recorded on a conveyed sheet.

The image forming portion 3 of the present embodiment employs an electro-photographic system in which toner images of respective colors of yellow, magenta, cyan, and black are sequentially formed on four photosensitive drums 3*a* arranged side by side, and the toner images are transferred and superposed on the intermediate transfer belt 3*b* so as to form a color image, and the color image is transferred to the conveyed sheet. The sheet on which the toner image has been transferred is conveyed upward, heated and pressed by the fixing portion 4 thereby fixing the toner image thereon, and then discharged to the discharge portion 5.

The image reading portion 6 is arranged on the upper part of the apparatus. The image reading portion 6 sequentially feeds an original document sheet set in the original document tray 6*a*, optically reads the original document sheet with the scanner portion 6*b*, converts the read information into a digital signal, and sends the digital signal to the image forming portion 3.

Figure 2A:
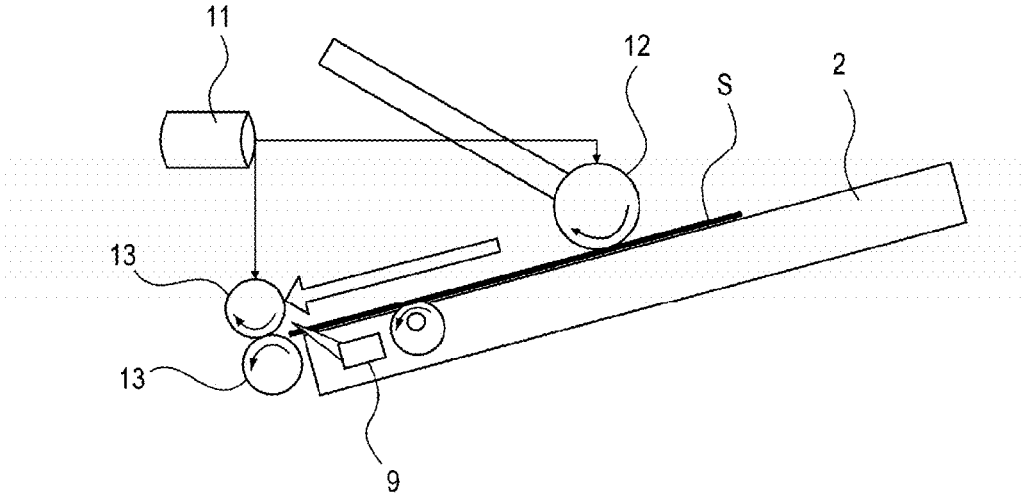
FIG. 2A is a cross-sectional view of a vicinity of a feeding tray in the embodiment of the present invention.
Figure 2B:
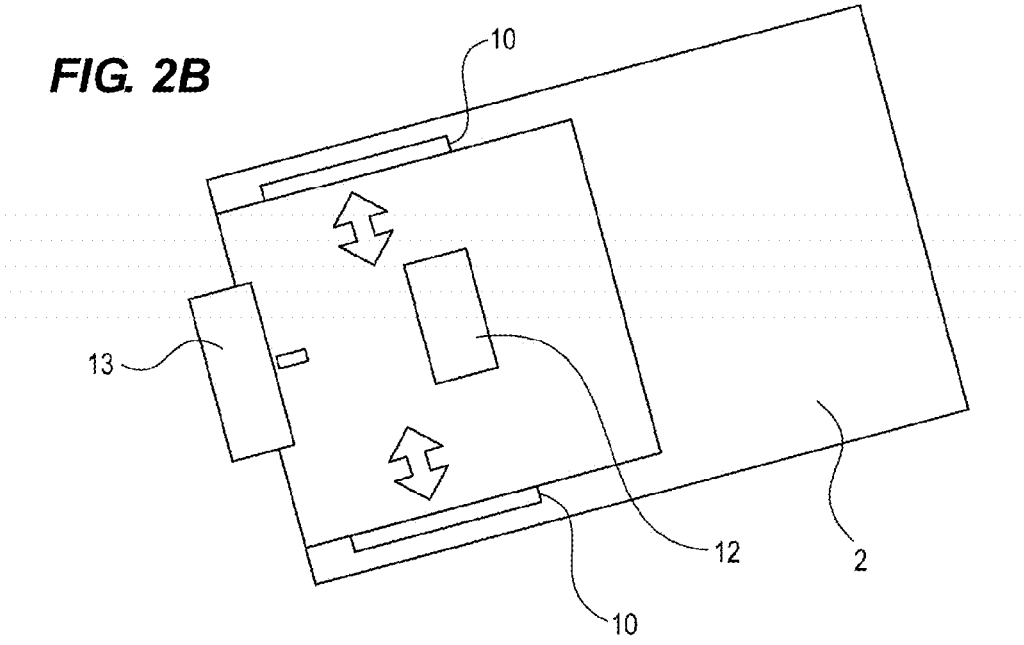
FIG. 2B is a plan view of a vicinity of a feeding tray in the embodiment of the present invention.

(Sheet feeding apparatus) Next, a sheet feeding configuration for feeding a sheet to the image forming portion 3 will be explained. FIGS. 2A and 2B are explanatory diagrams of the sheet feeding apparatus. FIG. 2A is a cross-sectional view of the sheet feeding apparatus and FIG. 2B is a plan view of the sheet feeding apparatus. As shown in FIG. 2, when the sheet S is placed on the feeding tray 2 and the sheet position is regulated with the side regulating member 10, the sheet presence/absence sensor 9 detects the sheet. When the sheet feeding signal is created, the feeding motor 11 is driven to rotate the pickup roller 12 and the feeding roller 13 thereby feeding the sheet. The fed sheet is brought in contact with the nip portion of the registration roller 14 (see FIG. 1) whose rotation is stopped and a loop is formed thereby correcting skew feeding of the sheet.

The registration roller 14 is a registration member and constitutes a conveying portion. The fed sheet is temporarily stopped at a predetermined position (the nip portion of the roller in the present embodiment) to stand by and the registration roller 14 is driven and rotated in synchronization with the timing of imaging of the toner image by the image forming portion 3 thereby conveying the sheet S again. As a result, the sheet is fed to the secondary transfer portion 15 in synchronization with the toner image formed by the image forming portion 3 and the toner image is transferred to a proper position of the sheet.

In the above explanation, as the configuration of the sheet feeding apparatus, the sheet feeding configuration from the feeding tray 2 is explained, however, the sheet feeding configuration from the sheet cassettes 1*a* and 1*b* is the same as that explained above.

Figure 3:
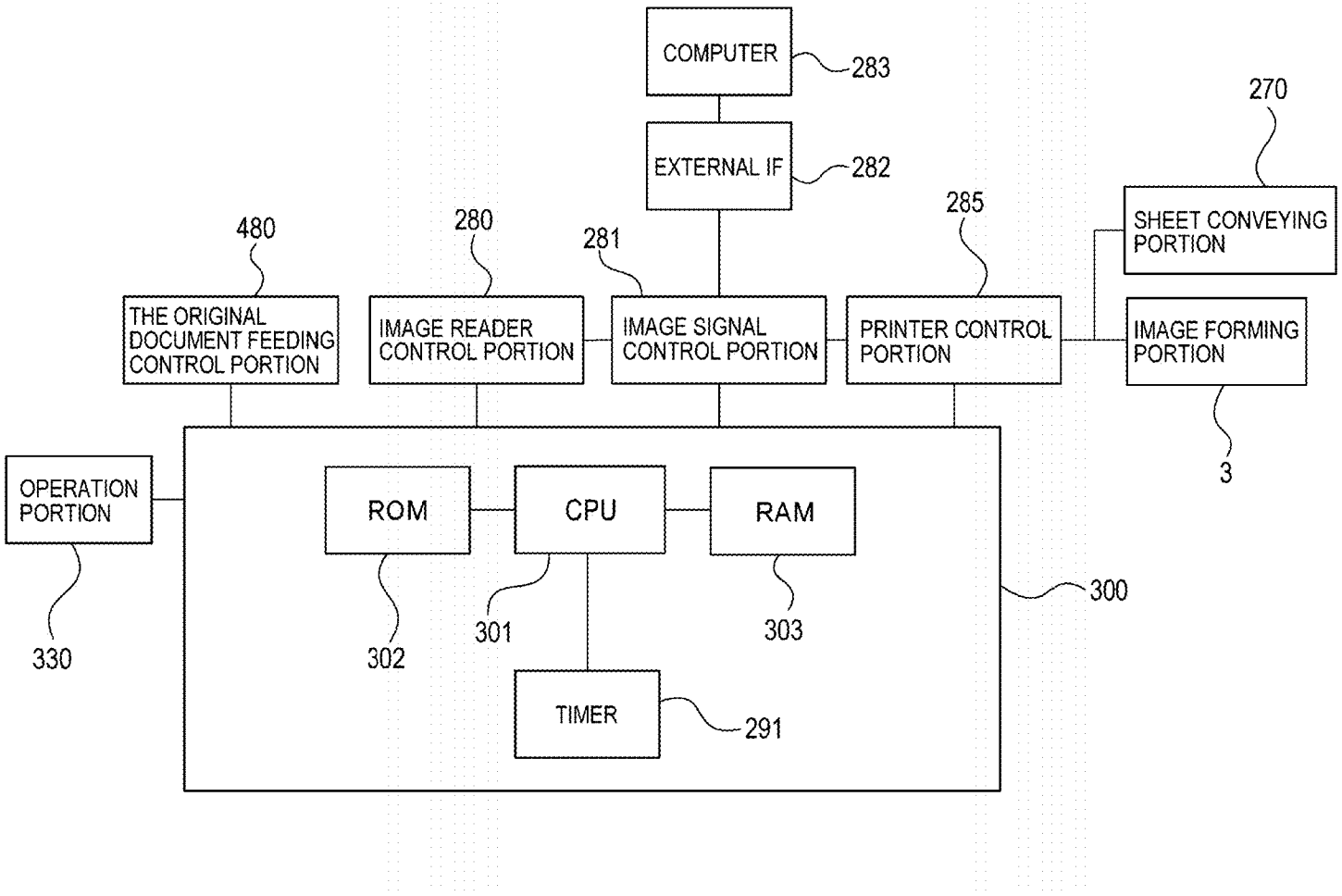
FIG. 3 is a control block diagram according to the embodiment of the present invention.

(Controlling portion) FIG. 3 is a block diagram showing a configuration of a controlling portion which controls the driving of the image forming apparatus. The control portion 300 performs a system control of the image forming apparatus and has the CPU 301 which performs the system control of the image forming apparatus including a sheet feeding control, the ROM 302 on which a control program is written, the RAM 303 which stores data and the timer 291 which performs time count.

The CPU 301 performs the original document feeding control of the image reading portion 6 via the original document feeding control portion 480. Further, the CPU 301 reads the image of the fed original document with the image sensor via the image reader control portion 280.

In the copy operation, the image signal control portion 281 processes a signal from the image sensor or the external computer 283 and outputs the processed signal to the printer control portion 285 via the external interface 282. The printer control portion 285 instructs the image forming portion 3 to form an image based on an instruction from the CPU 301. The image forming portion 3 drives the photosensitive drums 3*a* and so on based on the input video signal.

Also, based on an instruction from the CPU 301, the sheet feeding and the conveying control are performed for the sheet conveying portion 270 which controls driving of the pickup roller 12, the registration roller 14 and so on, which constitute the sheet feeding apparatus.

The operation portion 330 is used for selecting a color mode of forming an image, for displaying the state of the image forming apparatus, and for instructing a start of a copy and so on. Further, when the CPU 301 detects the sheet set on the feeding tray 2, a sheet size selection screen is displayed. The mode setting selected here is stored in the RAM 303.

Figure 4A:
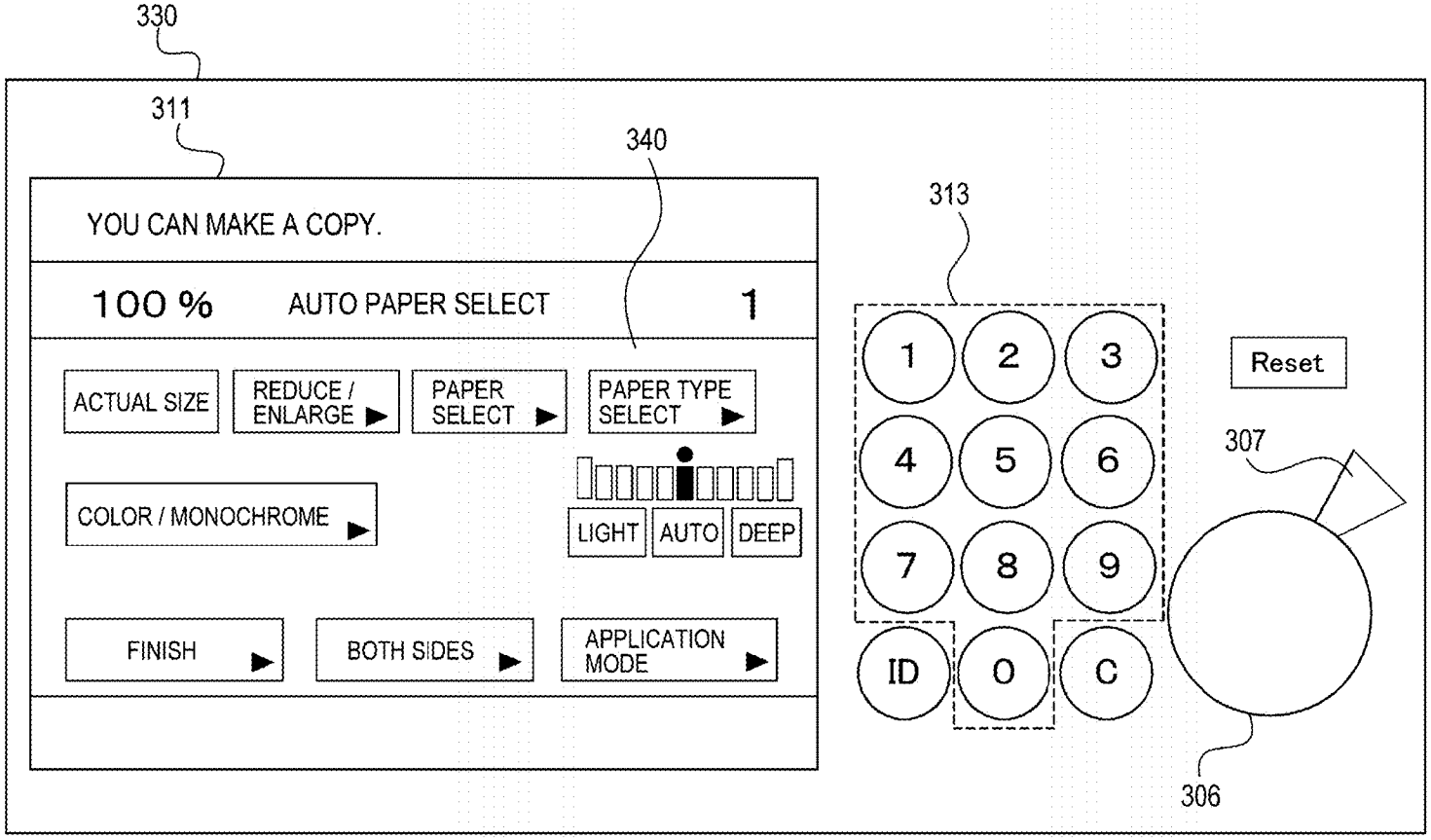
FIGS. 4A to 4E are diagrams of an operation portion of the embodiment of the present invention.

<Operation portion> Next, the operation portion 330 will be explained. FIG. 4A is a front view of the operation portion 330. The start key 306 for starting a copy operation, the stop key 307 for stopping the copy operation and the numeric keys 313 for setting a number are arranged on the operation portion 330. Further, the display portion 311 on which a touch panel is formed is arranged on the operation portion 330. Software keys can be created on the screen of the display portion 311. Further, the CPU 301 performs print preparatory operation control in response to an operation on the numeric keys 313 for setting a number or the like.

Figure 4B:
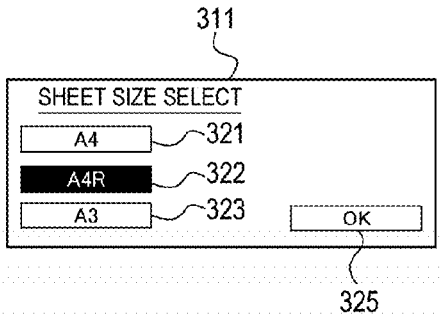
Figure 4C:
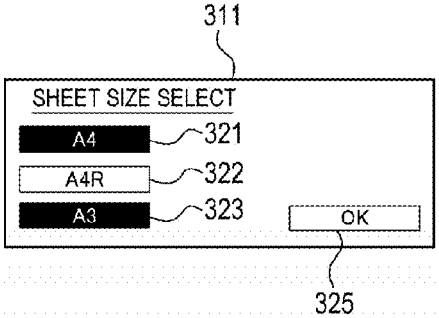

FIGS. 4B and 4C are a sheet size selection screen displayed on the display unit 311 when the sheet S is set on the feeding tray 2. As shown in these figures, the A4 button 321, the A4R button 322, the A3 button 323 and the size OK button 325 are arranged. By pressing the size OK buttons 325 with any other button being selected, the sheet size is determined and the selected sheet size is stored in the RAM 303.

FIG. 4B shows a screen displayed when the CPU 301 detects that the sheet size set on the feeding tray 2 is A4 or A3 based on the position of the side regulating plate 421 explained above. In this case, as shown in FIG. 4B, the A4 button 321 and the A3 button 323 can be selected, and the A4R button 322 is grayed out to be in a state in which the A4R button 322 is not selectable. On the other hand, FIG. 4C is a screen displayed when the CPU 301 detects that the sheet size set on the feeding tray 2 is A4R based on the position of the side regulating plate 421 explained above. In this case, as shown in FIG. 4C, the A4R button 322 can be selected, and the A4 button 321 and the A3 button 323 are grayed out to be in a state in which the A4 button 321 and the A3 button 323 are not selectable.

After the sheet size has been determined, when the CPU 301 detects no sheet based on the state of the sheet presence/absence sensor 9, the sheet size information is made uncertain and this information is also stored in the RAM 303. Thereafter, when the sheet S is set, the sheet size selection screen is displayed again. The printing operation cannot be started until the sheet size is determined.

Figure 4D:
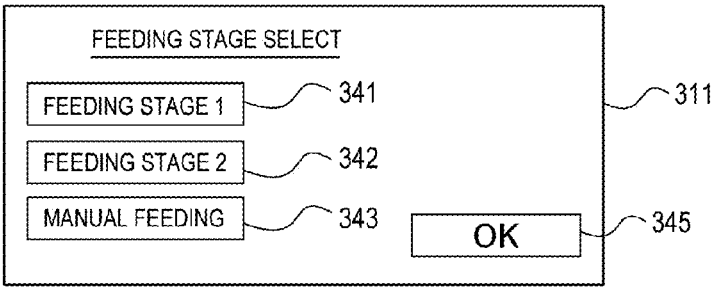
Figure 4E:
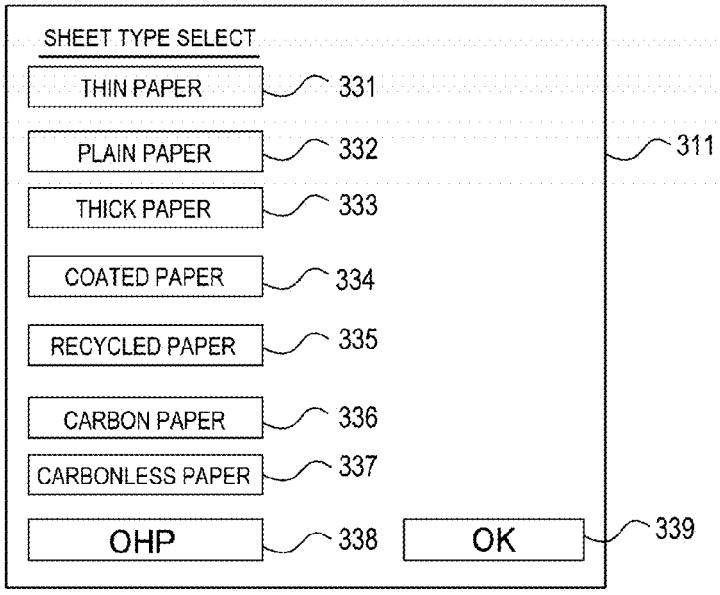

FIGS. 4D and 4E are a screen for selecting the type of sheets set in the image forming apparatus. When the sheet type selection screen 340 arranged on the display portion 311 is pressed, the feeding stage selection screen (FIG. 4D) is displayed. By pressing any of the feeding stage 1 button 341, the feeding stage 2 button 342 and the manual feeding button 343 and by pressing the feeding stage OK button 345, the sheet type selection screen (FIG. 4E) for selecting the sheet type is displayed.

On the sheet type selection screen, the thin paper button 331, the plain paper button 332, the thick paper button 333, the coated paper button 334, the recycled paper button 335, the carbon paper button 336, the carbonless paper button 337, the OHP button 338 and the type OK button 339 are arranged. By selecting one of the buttons 331 to 338 and then pressing the type OK button 339, the preselected feeding stage and sheet type are determined and this information is stored in the RAM 303. In the present embodiment, the type of sheet of each feeding stage is previously selected. However, the apparatus may be configured such that after the size OK button 325 is pressed, for example, the sheet type selection screen is displayed and the sheet type may be chosen on the sheet type selection screen. Further, the default sheet type of the present embodiment is set as plain paper.

In the present embodiment, the type of the sheet to be fed is determined, and the feeding timing is changed according to the type of the sheet. Further, in the present embodiment, the type determining portion determines the type of sheet based on the designation from the operation portion 330.

In the present embodiment, two sheet type groups for which the feeding start timing is changed are provided. The two sheet type groups consist of a first sheet type group including at least plain paper and a second sheet type group including at least coated paper. On the surface of a sheet whose type belongs to the first sheet type group including plain paper, deformation or the like hardly occurs on even when the sheet waits for a predetermined time at the position of the registration roller 14. Further, on the surface of a sheet whose type belongs to the second sheet type group including coated paper, deformation or the like easily occurs when the sheet waits for a predetermined time at the position of the registration roller 14.

In the present embodiment, as shown in FIG. 5, among the types of sheets set on the selection screen of FIG. 4E, thin paper, plain paper, thick paper, recycled paper belong to the first sheet type group. Sheet feeding with the timing for feeding a sheet whose type belongs to the first sheet type group is referred to as feeding type A. On the other hand, coated paper, carbon paper, carbonless paper and OHP belong to the second sheet type group. Sheet feeding with the timing for feeding a sheet whose type belongs to the second sheet type group is referred to as feeding type B.

<Feeding timing of a sheet whose type belongs to the first sheet type group> As explained above, in the present embodiment, the feeding timing performed in feeding type A when a sheet whose type belongs to the first sheet type group is different from the feeding timing performed in feeding type B when a sheet whose type belongs to the second sheet type group. Next, the feeding type A and the feeding type B will be explained in detail.

Figure 6:
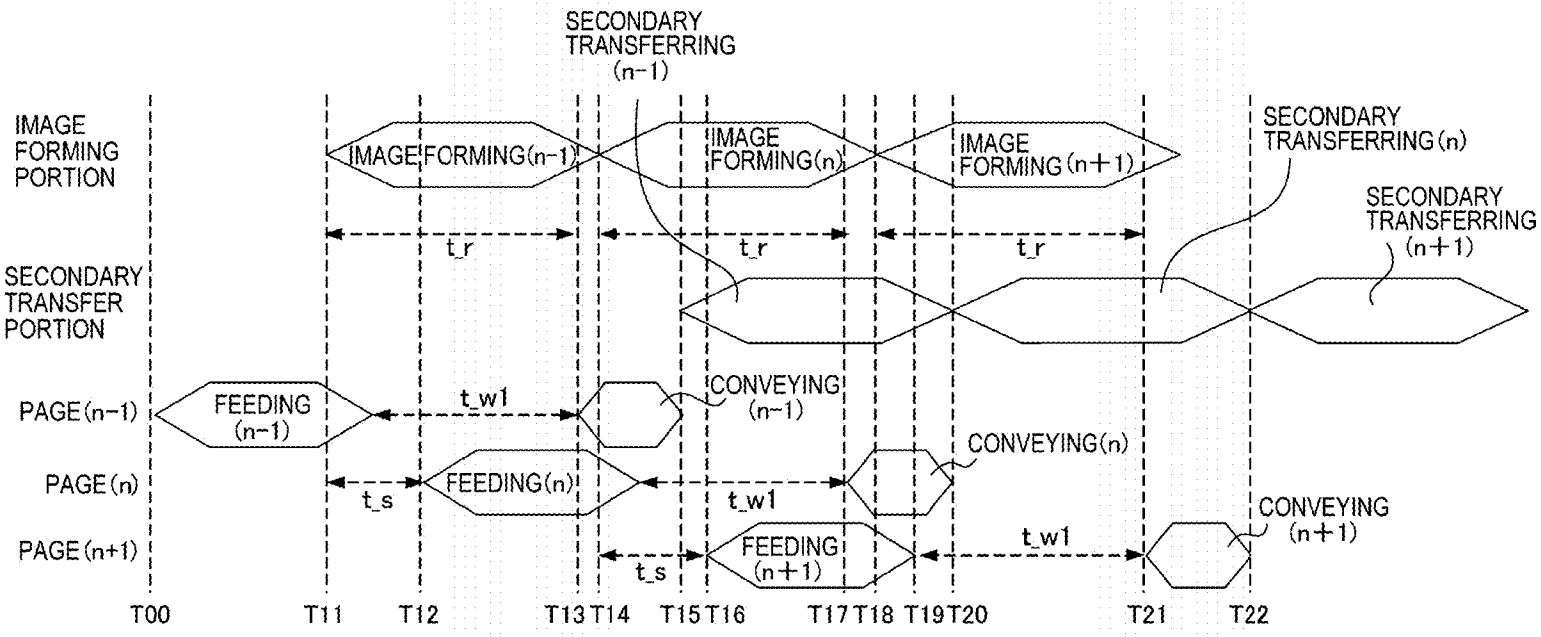
FIG. 6 is a timing chart for feeding by feeding type A.

First, the feeding type A for feeding a sheet which belongs to the first sheet type group will be explained. FIG. 6 is a sheet feeding timing chart of the feeding type A. The vertical axis represents the timing of image formation in the image forming portion 3, the timing of the image formation and the sheet in the secondary transfer portion 15 and the sheet conveying timings of the page (n−1), the page (n) and the page (n+1) (n is an integer).

First, the image forming timing in the image forming portion 3 will be explained. At timing T11, the image formation of the page (n−1) is started, and image formation of the page (n) is started at timing T14 while maintaining a predetermined image formation interval. Similarly, the image formation of the page (n+1) is performed at the timing T18.

In the secondary transfer portion 15, the toner images formed by the image forming portion 3 are matched with the conveyed sheets and secondarily transformed on the conveyed sheets at the timing T15 (page (n−1)), the timing T20 (page (n)) and the timing T22 (page (n+1)), respectively.

The feeding control is performed for the page (n−1) from the timing T00. Specifically, the timing T00 is determined by calculation from the timing T11 and the timing T13 so as to be the same as the timing of the following page.

In the sheet feeding control, a sheet from the feeding tray 2 is fed and the sheet is conveyed to the registration roller 14. In the present embodiment, when the sheet is conveyed to the registration roller 14, the sheet temporarily stops (waits) there with the leading edge of the sheet being in contact with the nip portion of the registration roller 14 thereby forming a loop. Then, the time t_r is determined based on the image formation start timing T11 of the current page so as to match the timing T15 at which the toner image of the page (n−1) reaches the secondary transfer portion 15. At the timing T13 at which the time t_r has elapsed from the image formation start timing T11, the sheet conveying control is restarted and at the timing T15, the sheet and the image are matched at the secondary transfer portion 15. As a result, the page (n−1) waits for the time t_w1 from the end of the feeding control to the restart of the conveying control. In the conveying control according to the present embodiment, a control is made for the conveying of the sheet from the registration roller 14 to the secondary transfer portion 15.

The page (n) waits for the time t_s from the image formation start timing T11 of the previous page (n−1) and the feeding control is started at the timing T12. This means that the feeding control of the target page starts from the image formation start timing of the previous page of the target page. Similarly to the previous page (n−1), the conveying control is restarted at the timing T17 at which the time t_r has elapsed from the image formation start timing T14 of the current sheet and at the timing T20, the toner image and the image are matched at the secondary transfer portion 15. As a result, the page (n) also waits for the time t_w1 from the end of the feeding control to the restart of the conveying control.

The feeding control for the page (n+1) is started at the timing T16 at which the page (n+1) has waited for the time t_s from the image formation start timing T14 of the previous page (n). Similarly to the other pages, the conveying control is restarted at the timing T21 at which the time t_r has elapsed from the image formation start timing T18 of the current sheet and at the timing T22, the toner image and the image are matched at the secondary transfer portion 15. As a result, the page (n+1) also waits for the time t_w1 from the end of the feeding control to the restart of the conveying control.

As explained above, in the case of the feeding type A which feeds a sheet whose type belongs to the first sheet type group, the sheet is fed from the feeding tray 2 prior to the image formation start timing. In this manner, by performing the sheet feeding control from the feeding tray 2 at an earlier timing, it is possible to perform retrying a plurality of times for a feeding error from the feeding tray 2, so that the apparatus is stopped less frequently due to feeding errors.

Next, the sheet feeding timing in the case where the image adjustment is performed while the images of a plurality of pages are continuously formed will be explained. In the image adjustment, for example, adjustment control for stabilizing the color taste is performed and the image formation is stopped during that time. Therefore, when image adjustment is not performed, the image formation is continuously performed at a predetermined interval, whereas when image adjustment is performed, the image formation interval becomes longer than the predetermined interval.

Figure 7:
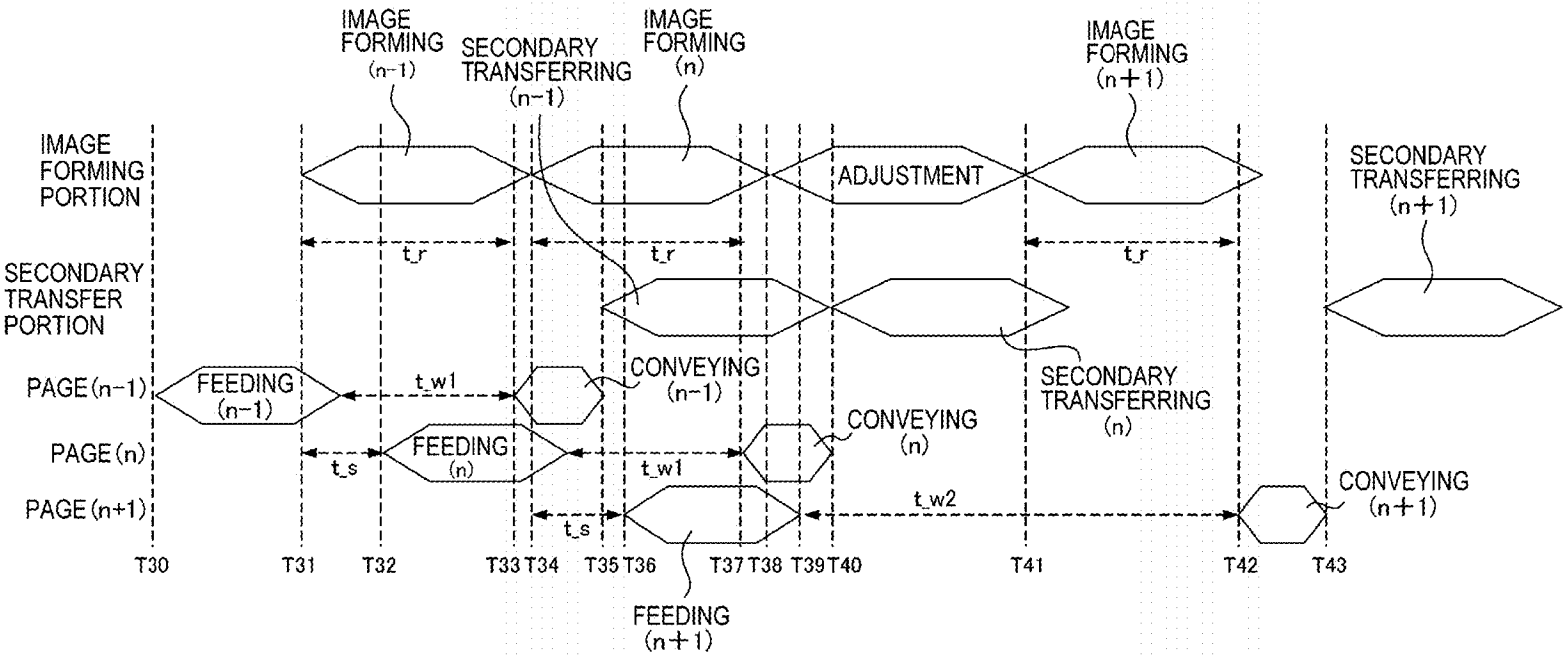
FIG. 7 is a timing chart for feeding by feeding type A with image adjustment.

FIG. 7 is a timing chart of the feeding type A in the case where the image adjustment is performed when an image is formed on a sheet whose type belongs to the first sheet type group.

Similarly to FIG. 6, the vertical axis represents the timing in the image forming portion 3, the timing in the secondary transfer portion 15 and the sheet conveying timings for the page (n−1), the page (n) and the page (n+1). Further, the image adjustment is performed between the page (n) and the page (n+1).

At timing T31, the image forming portion 3 starts the image formation of the page (n−1), and starts the image formation of the page (n) at the timing T34 while maintaining a predetermined image formation interval. Then, the image adjustment is performed from the timing T38 at which image formation of the page (n) has ended. Thereafter, the image formation on the page (n+1) is performed from the timing T41 at which the image adjustment is completed.

In the secondary transfer portion 15, the toner images formed by the image forming portion 3 are matched with the conveyed sheets and secondarily transformed on the conveyed sheets at the timing T35 (page (n−1)), the timing T40 (page (n)) and the timing T43 (page (n+1)), respectively.

The feeding for the sheet of page (n−1) is performed at the timing T30. Specifically, the timing T30 is determined by calculation based at the timing T31 or the timing T33 so as to be the same as the timing of the following page. The time t_r is determined based the image formation start timing T31 of the current page so as to match the timing T35 at which the toner image of the page (n−1) reaches the secondary transfer portion 15. At the timing T33 at which the time t_r has elapsed from the image formation start timing T31, the sheet conveying control is restarted and at the timing T35, the sheet and the image are matched at the secondary transfer portion 15. As a result, the page (n−1) waits for the time t_w1 from the end of the feeding control to the restart of the conveying control.

The sheet of the page (n) waits for the time t_s from the image formation start timing T31 of the previous page (n−1) and the feeding control is started at the timing T32. This means that the feeding control of the target page starts from the image formation start timing of the previous page of the target page. Similarly to the previous page (n−1), the conveying control is restarted at the timing T37 at which the time t_r has elapsed from the image formation start timing T31 of the current sheet and at the timing T40 the toner image and the image are matched at the secondary transfer portion 15. As a result, the page (n) also waits for the time t_w1 from the end of the feeding control to the restart of the conveying control.

The feeding control for the sheet of the page (n+1) is started at the timing T36 at which the page (n+1) has waited for the time t_s from the image formation start timing T34 of the previous page (n). The feeding control is completed at the timing T39. However, because the image adjustment is performed before the image formation of the page (n+1), the image formation of the page (n+1) is not immediately started. When the image formation of the page (n+1) is started at the timing T41 at which the image adjustment has ended, the conveying control is restarted at the timing T42 at which the time t_r has elapsed and at the timing T43, the toner image and the image are matched at the secondary transfer portion 15.

The feeding control for the sheet of the page (n+1) after the image adjustment is performed as explained above is started at the image formation start timing of the page (n). However, the restart of the conveying control is performed at the timing T42 and, as a result, the sheet of the page (n+1) waits for the time t_w2. Since the inequality t_w1<t_w2 holds, the sheet waits for a toner image for a longer time period at the registrationroller 14. However, in the case of a sheet whose type belongs to the first sheet type group such as plain paper, the surface shape is not deformed even if it is pressed against the registration roller 14 for a little longer period, so that a transfer failure or the like does not occur at the secondary transfer portion 15.

Figure 8:
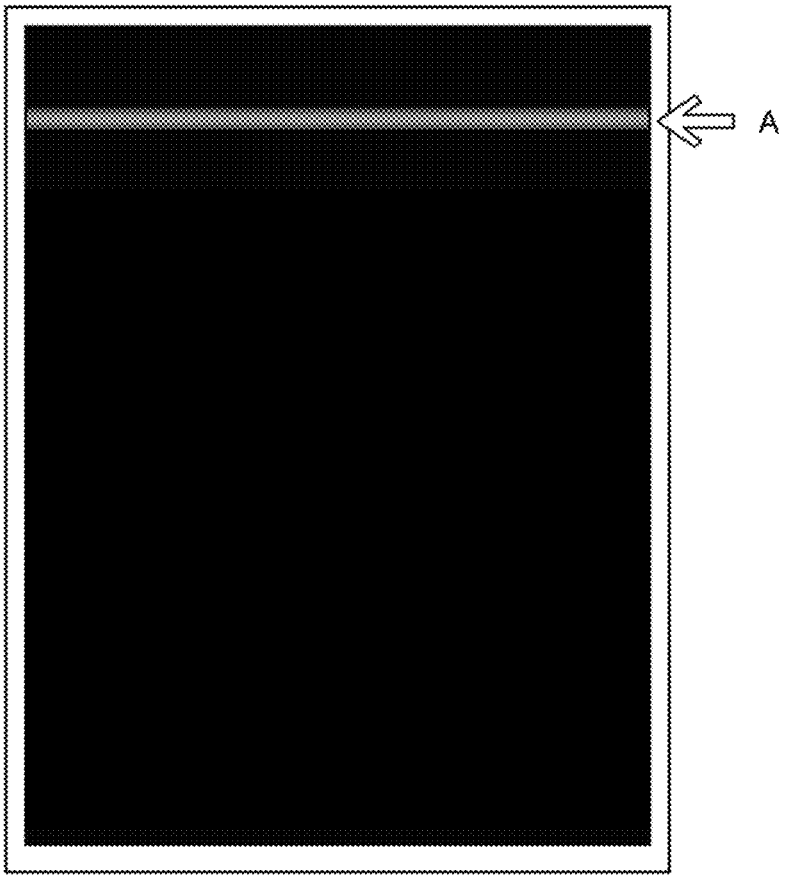
FIG. 8 is a diagram showing an image defect.

<Feeding timing of a sheet whose type belongs to the second sheet type group> When the type of a sheet to be fed belongs to the second sheet type group including coated paper and carbonless paper, there is a possibility that deformation or bending of the surface and so on may occur due to the sheet being pressed against the registration roller 14 for a long time. As a result, as shown in FIG. 8, there is a possibility that an image defect (arrow A in FIG. 8) occurs at the secondary transfer portion 15 due to transfer failures.

In the present embodiment, it is exemplified that the sheet is stopped with the leading edge of the sheet being pressed to the nip portion of the registration roller 14. However, the leading edge of the sheet may not be pressed to the nip portion roller and the sheet may stand by while being nipped between a pair of rollers including the registration roller 14. That is, if the sheet is stopped for a long time with the sheet being nipped by the registration roller, there is a possibility that an image defect may occur due to a change in the surface property of the nipped portion of the sheet by the pressure of the roller pair.

Figure 9:
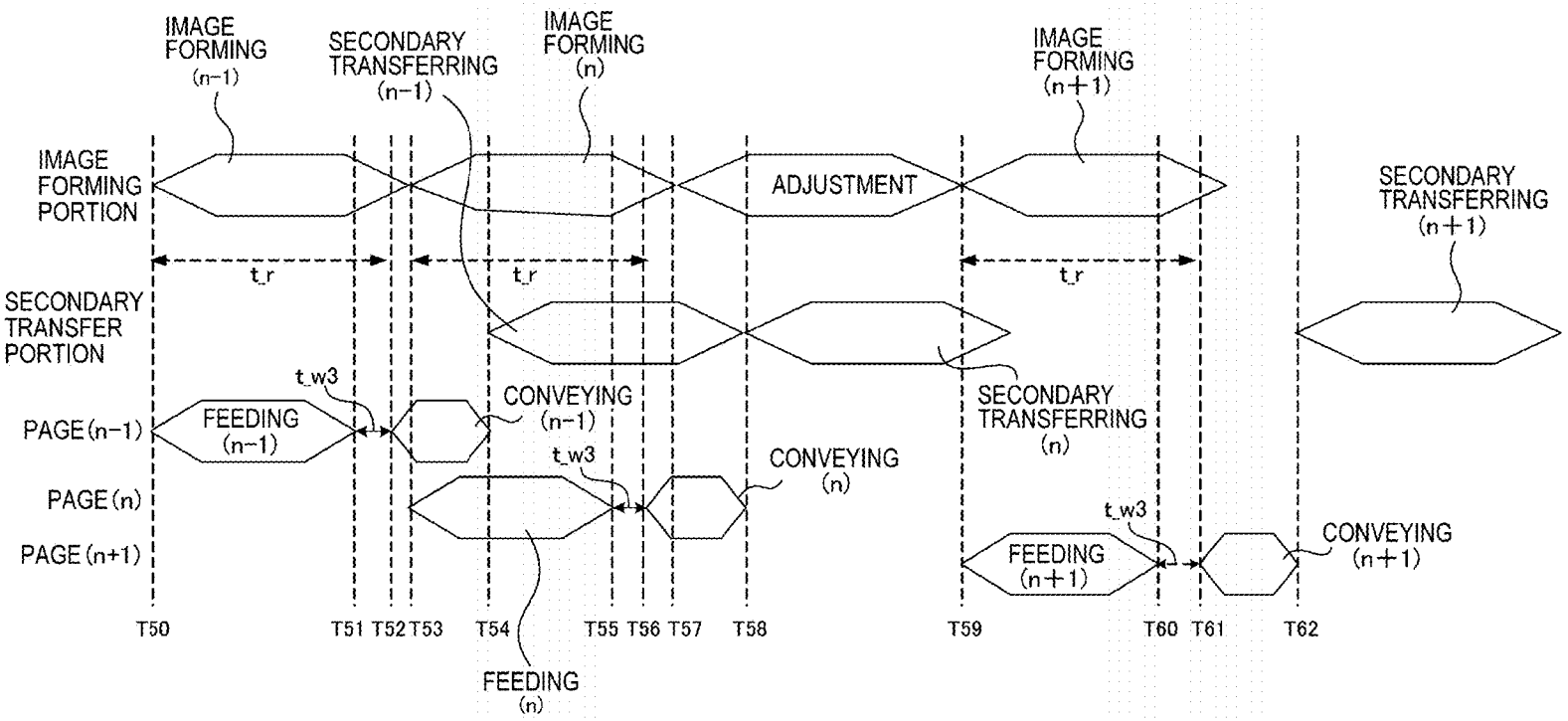
FIG. 9 is a timing chart for feeding by feeding type B.

Therefore, in the present embodiment, the sheet feeding start timing of the feeding type B for feeding a sheet whose type belongs to the second sheet type group is different from that of the feeding type A. FIG. 9 is a sheet feeding timing chart of the feeding type B, illustrating the case where image adjustment is performed between the page (n) and the page (n+1).

Similarly to FIGS. 6 and 7, the vertical axis represents the timing in the image forming portion 3, the timing in the secondary transfer portion 15 and the sheet conveying timings for the page (n−1), the page (n) and the page (n+1).

First, at timing T50, the image forming portion 3 starts the image formation of the page (n−1), and starts the image formation of the page (n) at the timing T53 while maintaining a predetermined image formation interval. Subsequently, the image adjustment is performed from the timing T57 and the image formation of the page (n+1) is performed from the timing T59.

In the secondary transfer portion 15, the toner images formed by the image forming portion 3 are matched with the conveyed sheets and secondarily transformed on the conveyed sheets at the timing T54 (page (n−1)), the timing T58 (page (n)) and the timing T62 (page (n+1)), respectively.

In the feeding type B, the sheet feeding control for the page (n−1) is performed from the image formation start timing T50 of the page (n−1). In the feeding type B, unlike the feeding type A, the feeding control is performed with the image formation start timing of the current sheet as a trigger. Specifically, the feeding operation is started immediately after the image formation start timing of the current sheet.

Then, the time t_r is determined based on the image formation start timing T50 of the current page so as to match the timing T54 at which the toner image of the page (n−1) reaches the secondary transfer portion 15. At the timing T62 at which the time t_r has elapsed from the image formation start timing T50, the conveying control is restarted and at the timing T54, the sheet and the image are matched at the secondary transfer portion 15. As a result, the page (n−1) waits for the time t_w3 from the end of the feeding control to the restart of the conveying control.

In this case, it is exemplified that the feeding operation is started immediately after the image formation start timing of the current sheet. However, it suffices if the feeding operation is performed accompanying the start of the image formation of the current sheet. For example, the feeding operation may be started after a predetermined time period elapsed from the image formation start timing of the current sheet. Also, the feeding operation may be started simultaneously with the image formation start timing of the current sheet, or the feeding operation may be started immediately before the image formation start timing of the current sheet.

Similarly, the feeding control for the page (n) is started from the image formation start timing T53 of the page (n). Next, the conveying control is restarted at the timing T56 at which the time t_r has elapsed from the image formation start timing T53 of the current sheet and at the timing T58 the toner image and the image are matched at the secondary transfer portion 15. As a result, the page (n) also waits for the time t_w3 from the end of the feeding control to the restart of the conveying control.

Similarly, the feeding control for the page (n+1) is started on the image formation start timing T59 of the current page. In this case, unlike the feeding type A, the feeding control is performed with the image formation start timing of the current sheet after the adjustment as a trigger. When the image formation for the page (n+1) is started at the timing T59, the conveying control is restarted at the timing T61 at which the time t_r has elapsed and the toner image and at the timing T62, the image are matched at the secondary transfer portion 15. As a result, the page (n+1) also waits for the time t_w3 from the end of the feeding control to the restart of the conveying control.

As explained above, in the feeding type A for feeding a sheet whose type belongs to the first sheet type group, the sheet feeding start timing of the sheet is set with the image formation start of the previous page as a trigger and the sheet is fed from the feeding tray 2 at a first timing prior to the image formation start timing of the current sheet. On the other hand, in the feeding type B for feeding a sheet whose type belongs to the second sheet type group, the image formation start timing of the current sheet is used as a trigger and feeding is started at a second timing which is later than the first timing.

As explained above, by changing the sheet feeding timing between the case where the type of a sheet belongs to the first sheet type group and the case where the type of a sheet belongs to the second sheet type group, the inequality t_w3<t_w1<t_w2 holds for the waiting time periods at the registration roller 14. As a result, in the feeding type B which feeds a sheet whose type belongs to the second sheet type group, it is possible to reduce the waiting time as compared with the control of the feeding type A, and it is possible to prevent the image defect as shown in FIG. 8. On the other hand, it is possible to realize a stable sheet conveying control without reducing paper jam margin due to the delay in feeding control when a sheet fed in the feeding type A in which no image defect occurs.

<Flowchart showing sheet feeding> Here, with reference to FIGS. 10 and 11, a flowchart of the start trigger of the sheet feeding control and a flowchart of the start trigger of the conveying control will be explained. The operations shown in the flowcharts of FIG. 10 and FIG. 11 are performed each time image formation of every page is performed.

Figure 10:
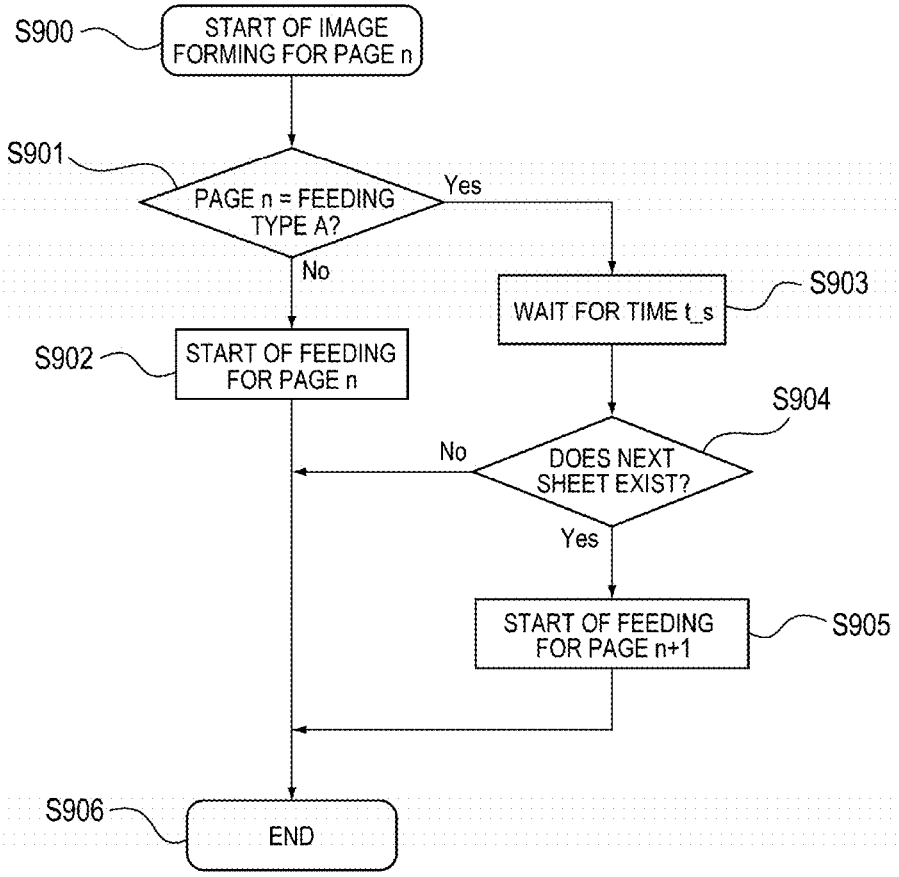
FIG. 10 is a flowchart showing an operation for triggering feeding control.

FIG. 10 is a flowchart showing a start trigger of the sheet feeding control. At the step S900, the image formation of the page (n) is started and the feeding type is confirmed which is set depending on whether the type of a sheet selected at the step S901 belongs to the first sheet type group or the second sheet type group. When the sheet is fed in the feeding type A, the process advances to the step S903 where the process waits for the time t_s and then the process advances to the step S904. At the step S904, it is confirmed whether the next sheet exists or not. When the next sheet exists in the step S904, the feeding control of the next page (n+1) is started at the step S905. On the other hand, if it is determined at the step S901 that the feeding type is B, since the feeding control of the current sheet is not started from the operation from the step S903, the feeding control of the current sheet (n) is started at the step S902.

As explained above, it is possible to decide whether the feeding control is started at the image formation start timing of the previous sheet or the feeding control is started at the image formation start timing of the current sheet depending on the feeding type.

Figure 11:
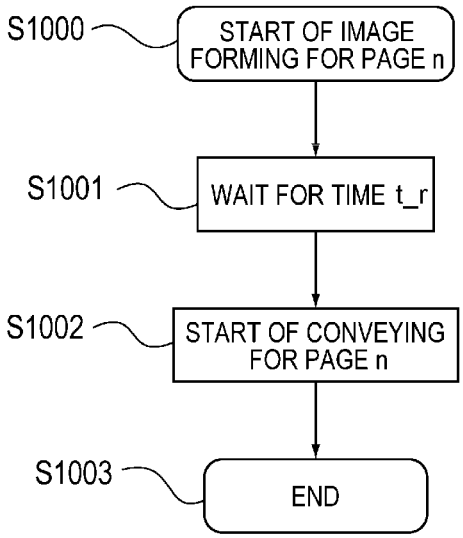
FIG. 11 is a flowchart showing an operation for triggering conveying control.

FIG. 11 is a flowchart for creating a start trigger for conveying control for conveying a sheet from the registration roller 14 to the secondary transfer portion 15. The image formation of the page (n) is started at the step S1000. The process waits for the time t_r at the step S1001. The conveying control of the page (n) is started at the step S1002. Then the process ends at the step S1003.

As explained above, according to the present embodiment, it is possible to perform a stable sheet conveying while preventing image defects by switching waiting time at the registration roller depending on whether the sheet is of a type in which it is highly possible that image defects such as transfer failure at the secondary transfer portion occur or not.

Figure 12:
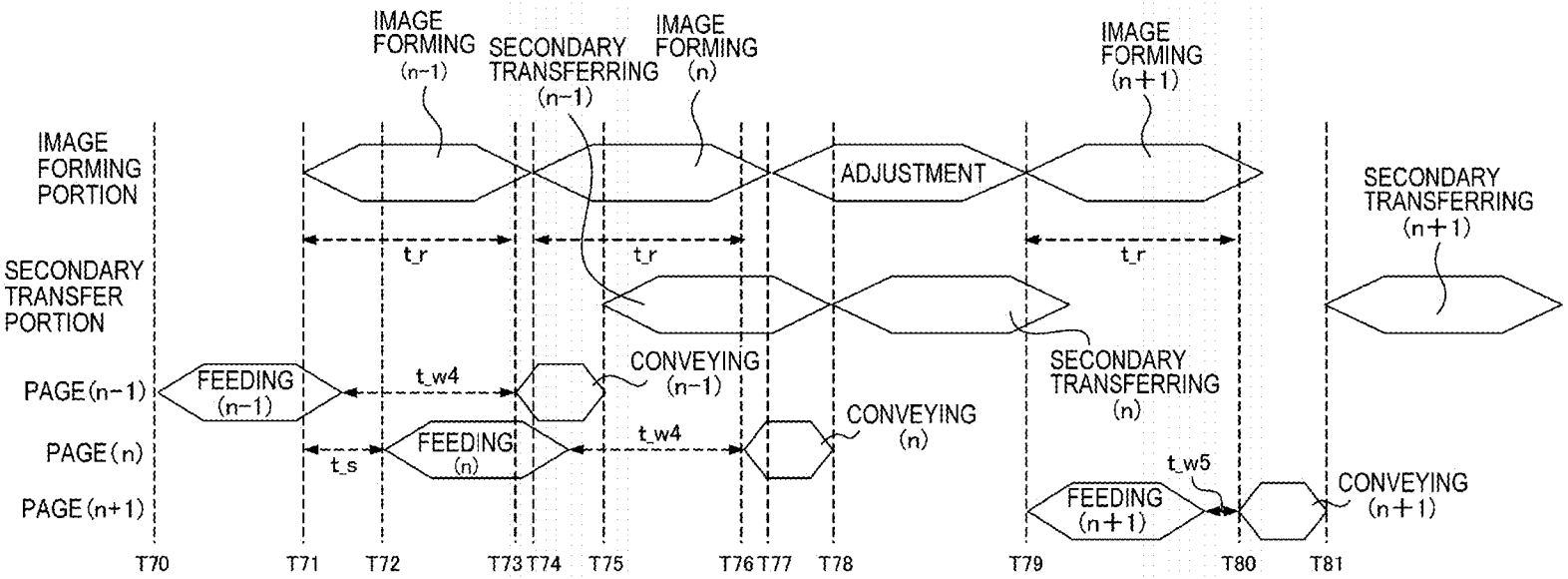
FIG. 12 is a timing chart of an embodiment in which the feeding timing is changed when image adjustment is performed.

{Second Embodiment} Next, a second embodiment of the present invention will be explained with reference to FIGS. 12 and 13. In the second embodiment, the sheet feeding timing in the feeding type B is different from that in the first embodiment, and the sheet feeding timing of the feeding type A is the same as that in the first embodiment. Therefore, only the sheet feeding timing in the feeding type B will be explained next.

In the first embodiment, in feeding a sheet whose type belongs to the second sheet type group, the sheet feeding timing is set with the image formation timing of the current sheet as a trigger irrespective of whether the image adjustment has occurred or not. However, in the present embodiment, when the image formation interval is equal to or less than the predetermined interval, the feeding is performed with the image formation timing of the previous sheet as a trigger, and when the image formation interval becomes longer than the predetermined interval due to image adjustment or the like, the feeding is performed with the image formation timing of the current sheet as a trigger. Whether image adjustment is to be performed or not is determined at the stage of image formation at least several pages before the image adjustment is performed.

Similarly to the other timing charts which are explained above, the vertical axis in FIG. 12 represents the timing in the image forming portion 3, the timing in the secondary transfer portion 15 and the sheet conveying timings for the page (n−1), the page (n) and the page (n+1). Further, the image adjustment is performed between the page (n) and the page (n+1).

First, the timing of image formation in the image forming portion 3 will be explained. At timing T71, the image formation of the page (n−1) is started and the image formation of the page (n) is started at the timing T74 while maintaining a predetermined image formation interval. Then, the image adjustment is performed from the timing T77. The image formation of the page (n+1) is performed from the timing T79.

(Feeding timing without image adjustment) In the secondary transfer portion 15, the toner images formed by the image forming portion 3 are matched with the conveyed sheets and secondarily transformed on the conveyed sheets at the timing T75 (page (n−1)), the timing T78 (page (n)) and the timing T81 (page (n+1)), respectively.

The feeding for the sheet of the page (n−1) is performed at the timing T70. Specifically, the timing T70 is determined by calculation based at the timing T71 or the timing T73 so as to be the same as the timing of the following page (not shown). The time t_r is determined based the image formation start timing T71 of the current page so as to match the timing T75 at which the toner image of the page (n−1) reaches the secondary transfer portion 15. At the timing T73 at which the time t_r has elapsed from the image formation start timing T71, the sheet conveying control is restarted and at the timing T75, the sheet and the image are matched at the secondary transfer portion 15. As a result, the page (n−1) waits for the time t_w4 from the end of the feeding control to the restart of the conveying control.

The page (n) waits for the time t_s from the image formation start timing T71 of the previous page (n−1) and the feeding control is started at the timing T72. This means that the feeding control of the target page is started from the image formation start timing of the previous page of the target page. Similarly to the previous page (n−1), the conveying control is restarted at the timing T76 at which the time t_r has elapsed from the image formation start timing T71 of the current sheet and at the timing T78, the toner image and the image are matched at the secondary transfer portion 15. As a result, the page (n) also waits for the time t_w4 from the end of the feeding control to the restart of the conveying control.

(Feeding Timing with Image Adjustment) The image adjustment is performed between the page (n) and the page (n+1). When it is determined that the image adjustment is to be performed, the control portion performs the feeding control not at the timing at which the time t_s has elapsed from the image formation start timing T74 of the previous page (n) as explained above, but at the image formation timing T79 of the current sheet.

When the image formation of the page (n+1) is started at the timing T79, the conveying control is restarted at the timing T80 at which the time t_r has elapsed, and at the timing T81, the toner image and the image are matched at the secondary transfer portion 15. As a result, the page (n+1) waits for the time t_w5 from the end of the feeding control to the restart of the conveying control.

As explained above, the feeding control is performed for the page (n+1) with the image formation timing of the current sheet as a trigger, the inequality t_w5<t_w4 holds. Thus, even if the image adjustment is performed between the pages, it is possible to prevent image defects as shown in FIG. 8 because the time in which the conveying is stopped is short.

Figure 13:
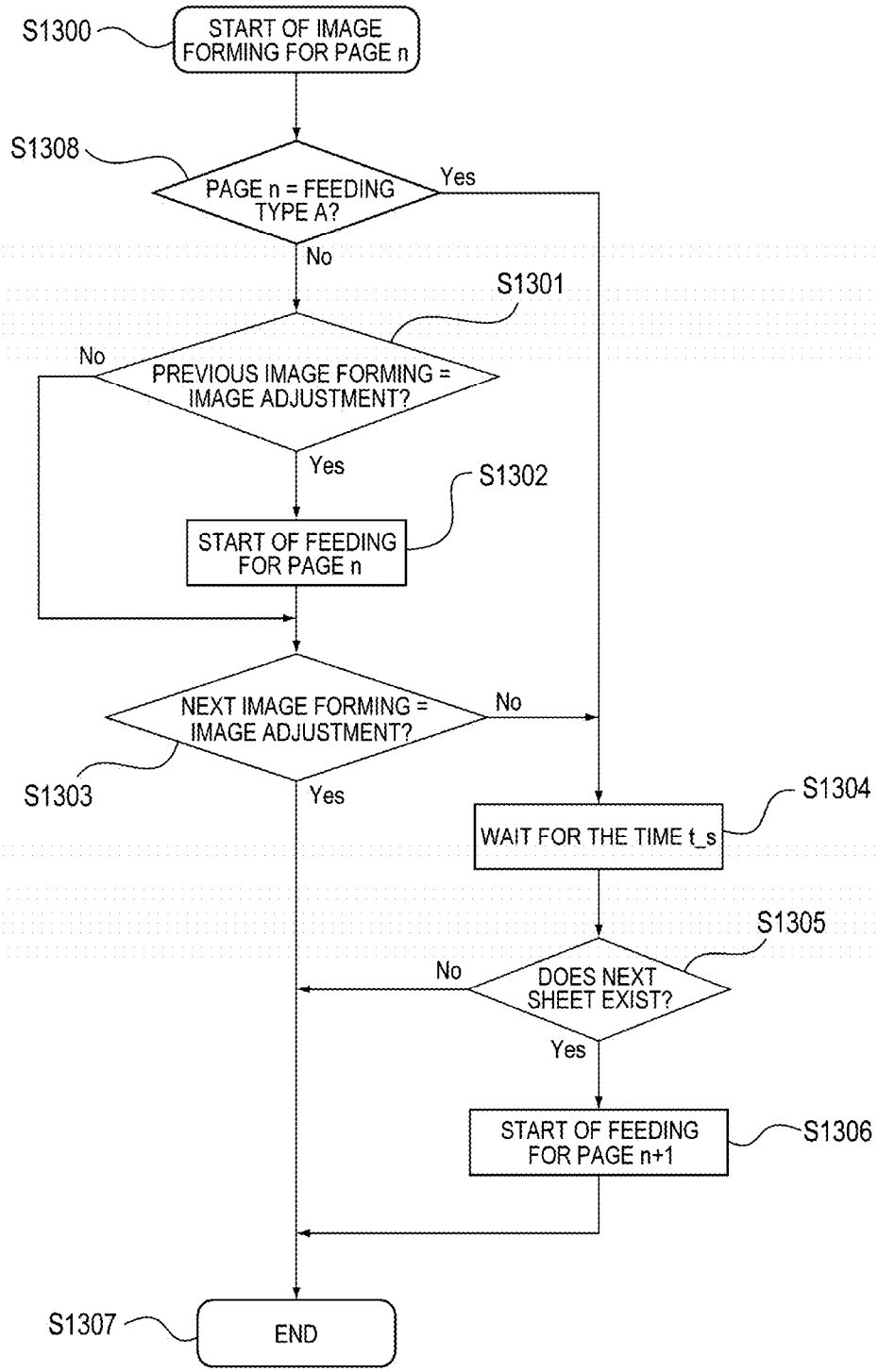
FIG. 13 is a flowchart for feeding in a case where image adjustment is performed.

FIG. 13 is a flowchart showing the start trigger of the feeding control. At the step S1300, the image formation of the page (n) is started. First, at the step S1308, the feeding type is judged. When the feeding type is A, the process shifts to the step S1304, and when the feeding type is B, the process shifts to the step S1301. At the step S1301, it is determined whether the procedure the image forming portion 3 has just performed is the image formation or the image adjustment. When the previous procedure is the image adjustment, the process proceeds to the step S1302, and when the previous procedure is the normal image formation, the process proceeds to the step S1303. At the step S1302, the sheet feeding control of the current page (n) is started simultaneously with the image formation of the current page because the image forming is performed after the image adjustment.

At the step S1303, it is determined whether the image formation or the image adjustment is to be performed next. When the image adjustment is to be performed next, the feeding control for the page (n) is ended, when the image formation is to be performed next, the process proceeds to the step S1304 where the process waits for the time t_s and determines whether there is a next sheet at the step S1305. When a next sheet exists, the process advances to the step S1306 where the feeding control of the next page (n+1) is started.

As explained above, when the image adjustment is to be performed next, the process proceeds to the next step without performing the feeding control.

As explained above, according to the present embodiment, when the image forming interval is equal to or less than a predetermined time even in the feeding type B, the image formation timing of the previous page is used as a trigger and a sheet is fed from the feeding tray 2 at an early timing. As a result, it is possible to perform retrying a plurality of times for a feeding error, so that the apparatus is stopped less frequently due to feeding errors. Further, when the image formation interval is longer than a predetermined interval, it is possible to prevent image defects by shortening the conveying stop time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-116132, filed Jun. 10, 2016, which is hereby incorporated by reference herein in its entirety.

What is claimed is:

1. An image forming apparatus, comprising:

a feeding portion configured to feed a sheet;

an image forming portion configured to form an image to be transferred on the sheet fed by the feeding portion;

a transferring portion configured to transfer the image formed by the image forming portion on the sheet;

a conveying portion configured to stop the sheet fed by the feeding portion at a predetermined position and to convey the sheet to the transferring portion so that the image formed by the image forming portion is transferred to the sheet;

a type discriminating portion configured to discriminate a type of the sheet to be fed; and a controlling portion configured to control the feeding portion, wherein the controlling portion changes a sheet feeding start timing at which the feeding portion starts to feed the sheet to the conveying portion based on the type of the sheet discriminated by the type discriminating portion, whereby a time period in which the sheet is being stopped by the conveying portion is changed based on the type of the sheet.

2. The image forming apparatus according to claim 1, wherein the sheet feeding start timing can be changed to a first timing and to a second timing at which feeding is started later than the first timing.

3. The image forming apparatus according to claim 2, wherein the type discriminating portion is configured to discriminate whether the type of the sheet to be fed belongs to a first sheet type group including at least a plain paper or to a second sheet type group including at least a coated paper, and wherein the controlling portion is configured to control the image forming apparatus such that when the type of the sheet belongs to the first sheet type group, the sheet is fed at the first timing and when the type of the sheet belongs to the second sheet type group, the sheet is fed at the second timing.

4. The image forming apparatus according to claim 2, wherein the type discriminating portion is configured to discriminate whether the type of the sheet to be fed belongs to a first sheet type group including at least a plain paper or to a second sheet type group including at least a coated paper, and wherein the controlling portion is configured to control the image forming apparatus such that in a case where an image forming interval is greater than a predetermined interval, the sheet is fed at the second timing when the type of the sheet to be fed belongs to the second sheet type group.

5. The image forming apparatus according to claim 2, wherein the type discriminating portion is configured to discriminate whether the type of the sheet to be fed belongs to a first sheet type group including at least a plain paper or to a second sheet type group including at least a coated paper, and wherein the controlling portion is configured to control the image forming apparatus such that in a case where the type of the sheet to be fed belongs to the second sheet type group, the sheet is fed at the first timing when an image forming interval is equal to or less than a predetermined interval and the sheet is fed at the second timing when an image forming interval is greater than the predetermined interval.

6. The image forming apparatus according to claim 2, wherein the first timing is a timing at which feeding of the sheet on which an image is to be formed is started prior to a start of forming the image by the image forming portion, and wherein the second timing is a timing at which feeding of the sheet on which an image is to be formed is started accompanied by formation of the image by the image forming portion.

7. The image forming apparatus according to claim 2, wherein the time period in which the sheet is being stopped by the conveying portion in a case where the sheet is fed at the second timing is less than that in a case where the sheet is fed at the first timing.

8. The image forming apparatus according to claim 1, wherein the type discriminating portion is configured to discriminate whether the type of the sheet to be fed belongs to a first sheet type group including at least a plain paper or to a second sheet type group including at least a coated paper, and wherein the controlling portion is configured to control the image forming apparatus such that (1) feeding of the sheet on which an image is to be transferred is started prior to a start of forming the image by the image forming portion when the type discriminating portion judges that the type of the sheet belongs to the first sheet type group and (2) feeding of the sheet on which an image is to be transferred is started accompanied by formation of the image by the image forming portion when the type discriminating portion judges that the type of the sheet belongs to the second sheet type group.

9. The image forming apparatus according to claim 1, wherein the controlling portion is configured not to change the sheet feeding start timing of the feeding portion irrespective of the type of the sheet in a case in which an image forming interval is a predetermined interval and to change the sheet feeding start timing of the feeding portion for the sheet based on the type of the sheet discriminated by the type discriminating portion and then a sheet stopping period by the conveying portion is changed in a case in which the image forming interval becomes greater than the predetermined interval.

10. An image forming apparatus comprising:

a feeding portion configured to feed a sheet;

an image forming portion configured to form an image to be transferred at a predetermined interval on the sheet sequentially fed by the feeding portion;

a transferring portion configured to transfer the image formed by the image forming portion on the sheet;

a conveying portion configured to stop a sheet fed by the feeding portion at a predetermined position and to convey the sheet to the transferring portion so that the image formed by the image forming portion is transferred to the sheet; and a type discriminating portion configured to discriminate whether a type of the sheet to be fed belongs to a first sheet type group including at least a plain paper or to a second sheet type group including at least a coated paper, wherein in a case that an image forming interval of the image forming portion is the predetermined interval and the type discriminating portion discriminates the sheet to be fed is the first sheet type, a time period to stop the sheet by the conveying portion is a first period, wherein in a case that the image forming interval of the image forming portion exceeds the predetermined interval and the type discriminating portion discriminates the sheet to be fed is the first sheet type, a time period to stop the sheet by the conveying portion is a second period which is longer than the first period, and wherein in a case that the image forming interval of the image forming portion exceeds the predetermined interval and the type discriminating portion discriminates the sheet to be fed is the second sheet type, a time period to stop the sheet by the conveying portion is a time period which is shorter than the second period.

11. The image forming apparatus according to claim 1, wherein the conveying portion includes a registration roller, and wherein the conveying portion is configured to stop the sheet with a leading edge of the sheet being in contact with the registration roller for correcting skew feeding of the sheet.

12. The image forming apparatus according to claim 10, wherein the conveying portion includes a registration roller, and wherein the conveying portion is configured to stop the sheet with a leading edge of the sheet being in contact with the registration roller for correcting skew feeding of the sheet.

13. The image forming apparatus according to claim 1, wherein the type discriminating portion is configured to discriminate the type of the sheet by the type of the sheet being designated by an operator.

14. The image forming apparatus according to claim 10, wherein the type discriminating portion is configured to discriminate the type of the sheet by the type of the sheet being designated by an operator.

15. The image forming apparatus according to claim 1, wherein in a case that a sheet type which the type discriminating portion discriminates is a first sheet type, the sheet feeding start timing at which the feeding portion starts to feed the sheet to the conveying portion is faster for a first time period than a timing of the image forming portion to start forming the image to be transferred on the sheet, and wherein in a case that a sheet type which the type discriminating portion discriminates is a second sheet type, a difference between the timing of the sheet feeding start timing and the timing of the image forming portion to start forming the image to be transferred on the sheet is shorter than the first time period.

16. The image forming apparatus according to claim 15, wherein in a case that a sheet type which the type discriminating portion is the second sheet type, the sheet feeding start timing at which the feeding portion starts to feed the sheet to the conveying portion and the timing to start forming the image to be transferred on the sheet are same.

17. The image forming apparatus according to claim 15, wherein the first sheet type involves a plain paper, and wherein the second sheet type involves a coated paper.

18. The image forming apparatus according to claim 15, wherein in a case that the image forming interval of the image forming portion exceeds the predetermined interval and the type discriminating portion discriminates the sheet to be fed is the second sheet type, the time period to stop the sheet is a third period shorter than the second time period, and wherein in a case that in a case that the image forming interval of the image forming portion does not exceed the predetermined interval and the type discriminating portion discriminates the sheet to be fed is the second sheet type, the time period to stop the sheet is a fourth period shorter than the third time period.

19. An image forming apparatus comprising:

a feeding portion configured to feed a sheet;

an image forming portion configured to form an image to be transferred at a predetermined interval on the sheet sequentially fed by the feeding portion;

a transferring portion configured to transfer the image formed by the image forming portion on the sheet;

a conveying portion configured to stop the sheet fed by the feeding portion at a predetermined position and to convey the sheet to the transferring portion so that the image formed by the image forming portion is transferred to the sheet;

a type discriminating portion configured to discriminate a type of the sheet to be fed; and a controlling portion configured to execute a first mode or a second mode based on the type of the sheet discriminated by the type discriminating portion, wherein in the first mode, a timing at which the feeding portion starts to feed the sheet toward the conveying portion is a timing earlier than a timing at which the image forming portion starts forming the image to be transferred on the sheet, and wherein a difference of the second mode between a timing at which the feeding portion starts to feed the sheet and a timing at which the image forming portion starts forming the image to be transferred on the sheet is shorter than a difference of the first mode between the timing at which the feeding portion starts to feed the sheet and the timing at which the image forming portion starts forming the image to be transferred on the sheet, wherein a stopping period of the sheet by the conveying portion in the second mode is shorter than the stopping period of the sheet by the conveying portion in the first mode.

20. The image forming apparatus according to claim 19, wherein the controlling portion executes the first mode based on that the type discriminating portion discriminates the sheet to be fed is a plain paper, and wherein the controlling portion executes the second mode based on that the type discriminating portion discriminates the sheet to be fed is a coated paper.

* * * * *